United States Patent [19]

Abraham et al.

[11] 4,254,984

[45] Mar. 10, 1981

[54] MOLD HANDLER

[75] Inventors: Edward D. Abraham; Robert F. Riha, both of Brecksville, Ohio

[73] Assignee: IMC-Carver Foundry Products, Inc., Muscatine, Iowa

[21] Appl. No.: 893,770

[22] Filed: Apr. 5, 1978

[51] Int. Cl.[3] ..... B66F 9/18

[52] U.S. Cl. ..... 294/88

[58] Field of Search ..... 294/88, 104, 106, 107, 294/108, 109, 67 BC, 67 R, DIG. 2; 214/147 R, 147 G, 653

[56] References Cited

U.S. PATENT DOCUMENTS

| | | | |
|---|---|---|---|
| 1,587,454 | 6/1926 | Wilson | 269/25 |
| 1,738,504 | 12/1929 | Stevens | 269/34 |
| 2,747,535 | 5/1956 | Curry | 269/34 |
| 3,677,428 | 7/1972 | Mallett | 294/88 |
| 3,905,635 | 9/1975 | Esser | 294/88 |
| 3,983,926 | 10/1976 | Muller | 294/88 |
| 3,997,069 | 12/1976 | McLange et al. | 294/88 |

*Primary Examiner*—James B. Marbert

*Attorney, Agent, or Firm*—Yount & Tarolli

[57] ABSTRACT

A material handling device for releasably gripping objects of various sizes is disclosed. The device comprises a pair of opposed gripping pads operable between a closed position in which the gripping pads engage opposite sides of the object and an open position in which at least one of the gripping pads is spaced from the object. Springs urge the gripping pads apart, and fluid motors apply a force opposed to the springs to move the gripping pads toward one another when fluid pressure is applied to the fluid motors. A fluid controller applies an adjustable minimum fluid pressure to the fluid motors to thereby adjustably limit the maximum distance between the grippers.

11 Claims, 6 Drawing Figures

12
10
22
26
26a
147
20
202
16

226
220
222
224
60
62
70
4
228
16
64
66
4

MOLD HANDLER

BACKGROUND OF THE INVENTION

The present invention relates to material handling devices and more particularly to a device for use in a foundry for handling molds or the like.

In the operation of a foundry an article such as a mold or sandcake is prepared into which molten metal is poured. Frequently, it is necessary to move such an article from one location to another. In addition it may be necessary to invert the article so that it rests on what was formerly its top surface. Consequently, a crane, a hoist or other similar apparatus is equipped with a handling device which engages opposite sides of the article to lift and move it from one location to another. Such devices for use in a foundry are well known.

One such mold handling device utilizes a pair of parallel moving gripper arms to engage opposite sides of a mold or sandcake. The gripper pads which contact the mold are rotatably mounted on antifriction bearings. This permits the mold to be rolled over to an inverted position while it is being lifted by the device.

The gripper arms of the known mold handling device must be kept parallel in order to maintain the gripper pads in coaxial alignment. If the gripper pads are not in coaxial alignment, the mold or other article can not be inverted while it is being lifted in the device.

Further, difficulties have been encountered in maintaining the center of gravity of the mold or other article in line with the cable which supports the mold handling device. If the load is not centered under the cable, the mold handling device may tilt dangerously, possibly injuring the workman or damaging the mold. In a known mold handling device a mechanical linkage is utilized to maintain the gripping arms equidistant from the center line of the cable which supports the device.

SUMMARY OF THE INVENTION

The present invention provides a material handling device which is adapted for use in a foundry for handling molds or the like. The mold handler of the present invention includes a greatly simplified structure for keeping a pair of opposed gripping arms symmetrically disposed about the axis of a cable from which the device is suspended.

The mold handler includes a horizontal support member to which the cable is connected. The arms are pivotally connected with the support member equidistant from the cable. Two identical springs connected with the support member and the arms urge the arms out of engagement with the mold or other object by causing the arms to pivot outward away from the mold. When pressurized, a pair of pneumatic motors oppose the force of the springs and cause the arms to pivot inward thus bringing them into engagement with the mold.

A control circuit regulates the flow of air to be pneumatic motors. The circuit enables an operator to selectively supply air to the motors to thereby engage the mold with the gripping pads or to release the air from the motors to disengage the pads from the mold. Because the springs and motors operating each arm are identical and because the control circuit supplies the same pressure to both motors, the motion of the arms is always identical. No complicated linkage interconnecting the arms is necessary. Thus the arms are always symmetrically disposed about the center line of the cable, and the load is always centered.

The control circuit also includes a pressure regulator which maintains an adjustable minimum pressure in the motors at all times. By varying the minimum pressure in the motors, the extent to which the arms pivot toward the disengaged position may be controlled. Increasing the minimum pressure increases the force opposing the springs and pivots the arms and pads toward an engaged position. Decreasing the minimum pressure decreases the force opposing the springs, and the arms are pivoted toward a disengaged position.

By limiting the extent of outward movement of the arms the cycling time required to grip a mold or other article is reduced. By adjusting the pressure regulator the arms may be brought to within a few inches of the mold. When many molds of the same size are being handled, the operation of the mold handler is speeded up because the stroke of the arms between the engaged and disengaged positions is as small as possible. This has the further advantage of greatly reducing the amount of air consumed by the mold handler.

Accordingly, it is an object of the present invention to provide a new and improved mold handler having a pair of opposed gripping arms for releasably engaging opposite sides of molds of various sizes and having a control system which limits the maximum distance between the arms.

It is a further object of the present invention to provide a new and improved mold handler as set forth in the preceding object adapted to maintain the object lifted centered in the mold handler and including a pair of springs to urge the arms toward disengagement from an object to be gripped by the device and a pair of fluid motors responsive to a supply of fluid under pressure to oppose the force of the springs to move the pads into engagement with the object.

It is a further object of the present invention to provide a new and improved mold handler as set forth in the preceding object and further including a control system for adjustably limiting the extent of disengagement of the pads from an object to be gripped by supplying an adjustable minimum pressure to the fluid motors at all times.

These and other objects and features of the present invention will become more apparent from a reading of the following specification taken together with the accompanying drawings in which:

DESCRIPTION OF ONE PREFERRED EMBODIMENT

Figure 1:
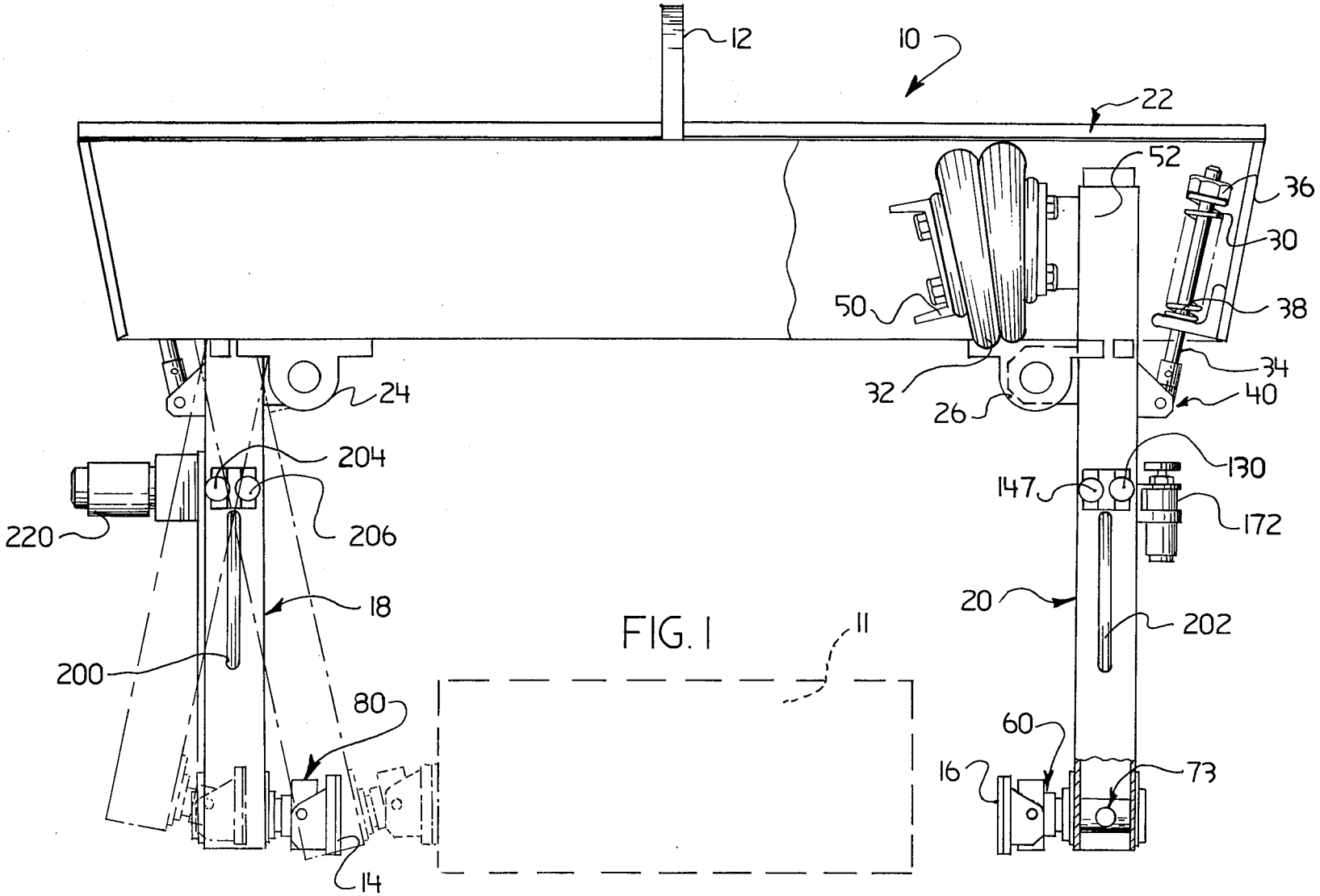
FIG. 1 is a partly sectional front view of a mold handler constructed in accordance with the present invention and having a pair of pivotable arms with gripping pads.

A mold handler 10 constructed in accordance with the present invention is illustrated in FIG. 1. The mold handler 10 is particularly suited for handling a mold sandcake or other article 11 used in a foundry. However it is to be understood that the mold handler 10 of the present invention may be equally well suited to lifting other objects. The mold handler 10 includes an eye 12 for connecting the device with a hoist or a crane (not shown). When the mold 11 is engaged by the gripping pads 14 and 16, it may be lifted and rotated about a generally horizontal axis to turn it upside down.

Figures 2, 3:
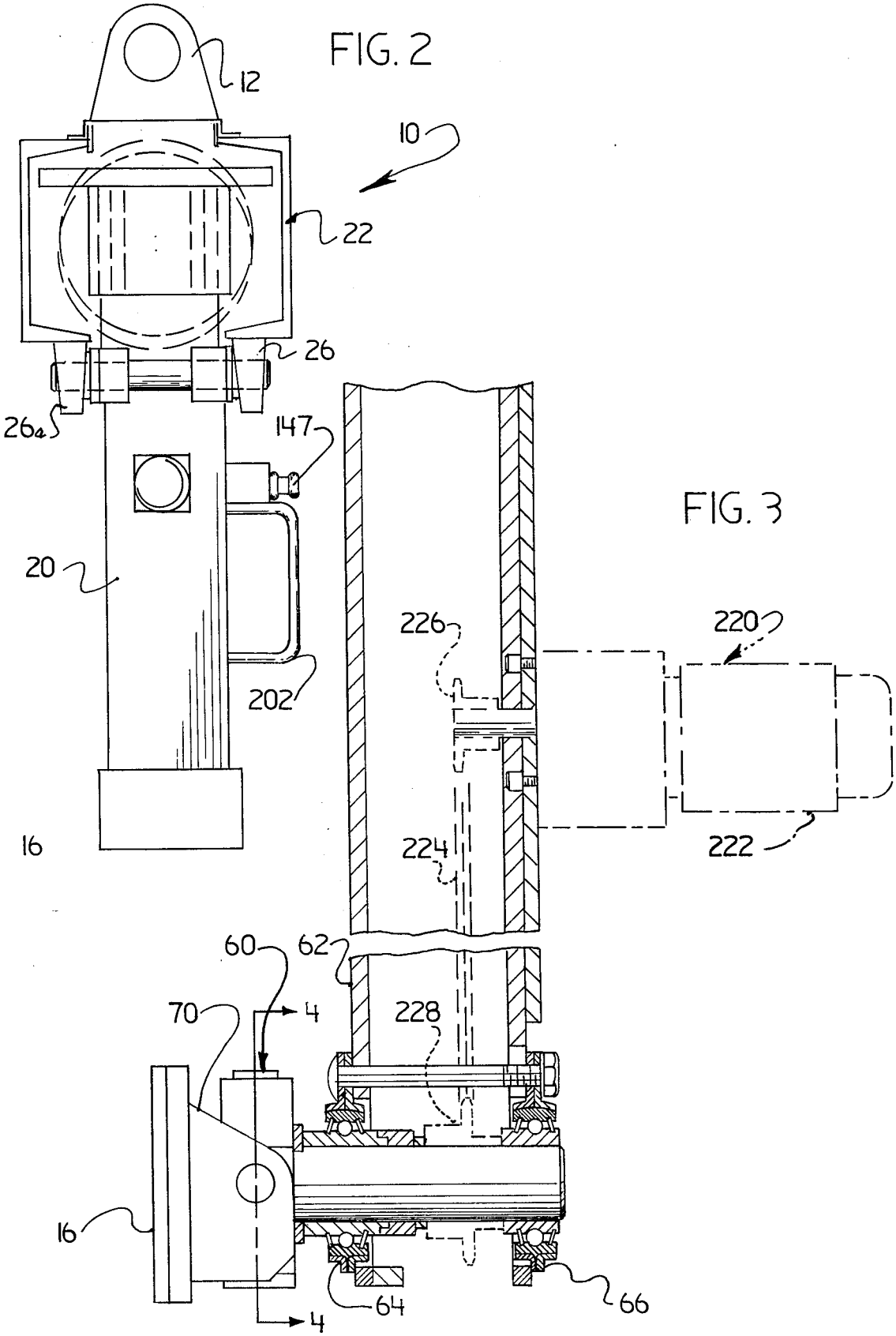
FIG. 2 is a side elevational view of the mold handler of FIG. 1.
FIG. 3 is a rear sectional view on an enlarged scale of an arm and gripping pad of FIG. 1.

The gripping pads 14 and 16 are brought into engagement with the mold 11 by the action of arms 18 and 20. The gripping pads 14 and 16 are connected with arms 18 and 20. The arms 18 and 20 are rigid and are pivotally connected with a rigid horizontal support member 22 by four antifriction bearings 24,, 26 and 26*a* (one not shown) (FIGS. 1 and 2). The bearings 24, 26 and 26*a* which support the arms 18 and 20 are equidistant from the eye 12. The arms are rotatable between a position in which the pads 14 and 16 are spaced apart from the mold 11 and a position in which the pads are in engagement with the mold.

The arm 18 and the apparatus which controls its motion is substantially the same as the arm 20 and the apparatus which controls its motion. The major differences between arms 18 and 20 are related to left and right handedness. For instance, the pad 16 extends from the left side of the arm 20 (as viewed in FIG. 1) while the pad 14 extends from the rightside of the arm 18, and the arm 20 moves clockwise to engage the mold 11, while the arm 18 moves counterclockwise to engage the mold. Except where it is necessary to distinguish between the arms 18 and 20, only the arm 20 will be described. However, it will be understood that the description applies equally to the arm 18, once the necessary and obvious changes have been made.

The motion of the arm 20 (FIG. 1) is controlled by a spring 30 and a pneumatic motor 32. The helical coil spring 30 applies a force to the arm 20 which causes the arm 20 to rotate about the axis of bearing 36 in a counterclockwise direction. This motion of the arm moves the pad 16 away from the mold 11.

The spring 30 transmits its force to arm 20 through a threaded rod 34. One end of the spring 30 abuts a nut 36 which is threadably engaged by the rod 34. The other end of the spring 30 abuts a support surface 38 which is fixedly connected with the horizontal support member 22. When the spring pushes the nut 36 and the rod 34 upward, the force is transmitted to the arm 20 through a pivot joint 40. This moves the arm 20 in a counterclockwise direction.

A pneumatic motor 32 applies a force to the arm 20 which opposes the force of the spring 30 and tends to move the arm in a clockwise direction around the axis of the antifriction bearing 26. This motion brings the pad 16 into contact with the mold 11. When air under pressure is supplied to pneumatic motor 32, it applies a force proportional to the pressure of the air supply. The pneumatic motor 32 applies a force between a member 50 fixedly connected with the horizontal support member and the upper end portion 52 of the arm 20. Such a pneumatic motor is readily available under the trade name "Airide".

When air under pressure is supplied to the motor 32, the force applied to the upper end portion 52 of the arm 20 tends to move the pad 16 into engagement with the mold 11. Increasing the pressure in the motor 32 increases the force with which the pad 16 grips the mold 11. Decreasing the air pressure in the motor 32 causes the arm 20 to rotate and the pad 16 to move away from the mold 11.

It will be observed that by the design of the mold handler 10, the arms 18 and 20 are always symmetrically spaced from a vertical center line through the cable eye 12. The springs 30 (one not shown) which urge each arm 18 and 20 away from the article 11 are identical. The pneumatic motors 32 (one not shown) which operate to bring the arms 18 and 20 toward the article 11 are not only identical, they are supplied with the same air pressure. Thus without the use of complicated linkages or gears, the present invention assures that the load will be carried directly in line with the cable and cable eye 12.

When the pad 16 is disengaged from the mold 11, the angular position of the arm 20 may be adjusted by adjusting the air pressure in the motor 32. This in turn regulates the maximum distance between the pad 16 and the mold 11. The force exerted by the spring 30 on the arm 20 decreases as the arm rotates counterclockwise (as viewed in FIG. 1) and the spring gets closer to its free length. When the air pressure in the motor 32 is decreased, the arm 20 will be subject to a spring force which moves the arm counterclockwise until the spring force is in equilibrium with the motor force. So, by adjusting the minimum pressure in the motor 32, the position of the arm 20 and the pad 16 may be controlled. A pneumatic control circuit adapted to regulate the minimum motor pressure is included in the present invention and will be discussed below.

Figure 4:
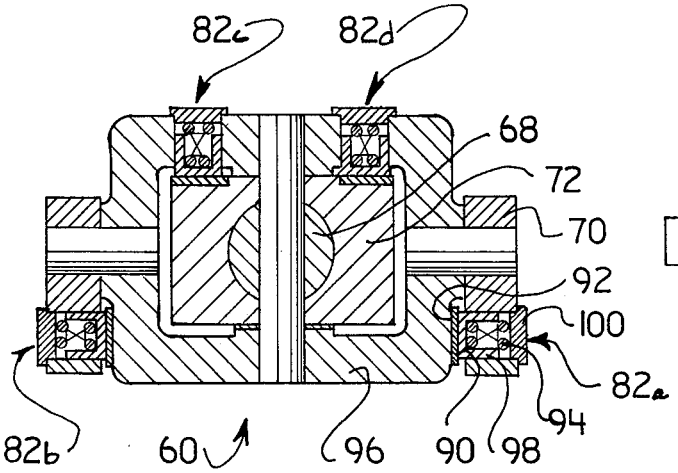
FIG. 4 is a sectional view taken along line 4—4 of FIG. 3 showing the connection between an arm and a gripping pad.

The mold handler 10 is adapted to permit a mold 11 to be turned upside down while it is held between the pads 14 and 16. The pad 16 (FIG. 3) is connected with the arm 20 by a rotatably mounted universal joint 60. At the lower end portion 62 of the arm 20 a pair of self-aligning bearings 64 and 66 are used to rotatably mount shaft 68. The pad 16 is connected with the outer member 70 of the universal joint 60 and the shaft 68 is connected with the inner member 72 (FIG. 4). Thus the entire pad 16 and the mold 11 which it engages may be rotated about an axis coincident with the axis of the shaft 68.

Figure 5:
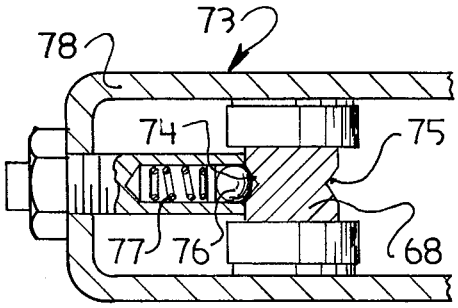
FIG. 5 is an enlarged sectional view of a portion of FIG. 1.

The shaft 68 may be provided with a detent mechanism 73 shown in FIG. 1 and in more detail in FIG. 5. The detent mechanism 73 enables the shaft 68 to be retained in either of two positions. In one position the mold 11 engaged by the mold handler 10 is right side up, and in the other the mold is upside down. A pair of recesses 74 and 75 are formed diametrically opposite each other on the shaft 68. The recesses 74 and 75 receive the ball 76 which is urged into the recesses by a spring 77. The spring 77 and ball 76 are held in fixed relationship with the arm 20 by a housing 78. Thus the detent mechanism 73 enables the shaft 68 to be retained preferentially in two angular positions which are 180° apart.

The universal joint 60 (FIG. 1) is provided to facilitate gripping and rotating objects of various sizes and shapes. When the mold 11 to be gripped is relatively small, the arms 18 and 20 must be pivoted inward until the pads 14 and 16 engage the sides of the object. In this position the shaft 68 which supports the pad 16 and the similar shaft (not shown) which supports pad 14 are not in coaxial alignment. The universal joint 60 on arm 20 and the similar universal joint 80 on arm 18 make it possible for the gripped mold 11 to be rotated even when the shafts which support the pads 14 and 16 are not in coaxial alignment.

The universal joint 60 (FIG. 4) is provided with friction clutches 82*a*, 82*b*, 82*c*, and 82*d*. The clutches 82*a*, 82*b*, 82*c*, and 82*d* provide internal friction to oppose the force of gravity acting on the joint 60. Thus the clutches 82*a*, 82*b*, 82*c*, and 82*d* enable the joint 60 to remain in whatever angular position it is placed. The friction forces created by the clutches 82*a*, 82*b*, 82*c*, and 82*d* are no greater than necessary to achieve the above stated object. The joint 60 remains sufficiently flexible to permit motion in any direction when a mold 11 is gripped by the mold handler 10 (FIG. 1) and a moderate force is applied to the mold.

The friction clutches 82*a*, 82*b*, 82*c*, and 82*d* are substantially identical and consequently only the clutch 82*a* will be described in detail. However, it is understood that the description of joint 82*a* applies equally well to the clutches 82*b*, 82*c* and 82*d*.

The friction clutch 82*a* includes two friction surfaces 90 and 92 urged into abutting engagement by a spring 94. The friction surface 90 is adhered to the gimbal 96 by any suitable means. The friction surface 92 is the end surface of a hollow cylindrical member 98 which is slidably engaged by a cylindrical passage through the outer member 70 of the universal joint 60.

When the outer member 70 and the gimbal 96 move with respect to one another, the friction clutch 82*a* opposes the motion. Spring 94 urges the friction surfaces 90 and 92 into firm contact by pressing between the cylindrical member 98 and a cap 100.

The mold handler 10 (FIG. 1) is powered pneumatically. A control circuit 110 for the mold handler 10 is illustrated schematically in FIG. 6. The purpose of the circuit 110 is to enable an operator of the mold handler 10 to engage or release a mold with the mold handler. The circuit also provides an adjustment which limits the maximum opening of the arms 18 and 20.

The control circuit 110 includes a supply 112 of air under pressure, a filter 114 and a lubricator 116. Cleaned and lubricated air is supplied through conduits 118, 120, 122, and 124 to valves 126 and 128.

To cause the device 10 to engage a mold 11, the operator presses on knob 130 to move the two-position valve 126 to its alternate position. The valve 126 is spring biased to a closed position, and when the button 130 is pushed, the valve moves to its alternate open position. Air then flows through conduit 132 to a pilot port 133 of the pilot operated valve 134.

The pilot operated valve 134 controls the flow of air into the pneumatic motors 32 and 136. A short burst of air pressure released into the pilot port 133 by pushing button 130 is sufficient to cause the valve 134 to move to the position shown in FIG. 6. Air then flows through conduit 118 through a check valve 140 and a flow restricter 142, through the valve 134 and conduits 144, 145, and 146 to the pneumatic motors 32 and 136.

The check valve 140 provides an important safety feature. In the event of a loss of air pressure from the air supply 112, the check valve 140 is effective to prevent air in the motors 32 and 136 from being released to the atmosphere. This prevents the mold handler 10 from releasing the mold 11 during a temporary loss of power.

To disengage the mold 11 from the mold handler, the operator pushes button 147 on valve 128 to move the valve against its spring bias to its alternate position. Valve 128 operates in substantially the same manner as valve 126. Moving the valve 128 from the position shown in FIG. 6 to its alternate position, causes a burst of air pressure to flow through conduit 150 to pilot port 152 of pilot operated valve 134. This in turn moves the valve 134 from the position shown in FIG. 6 to its alternate position. Air from the motors 32 and 136 then flows back through conduits 144 and 145 and to the atmosphere through a flow restricter and muffler indicated generally at 156.

A pilot operated shuttle valve 170 and a pressure regulator 172 cooperate to maintain a preselected minimum pressure in the motors 32 and 136. The pressure regulator 172 is supplied with high pressure air from the air supply 112 via conduit 174. The pressure regulator 172 may be adjusted to vary the pressure downstream of the regulator in conduit 176.

Figure 6:
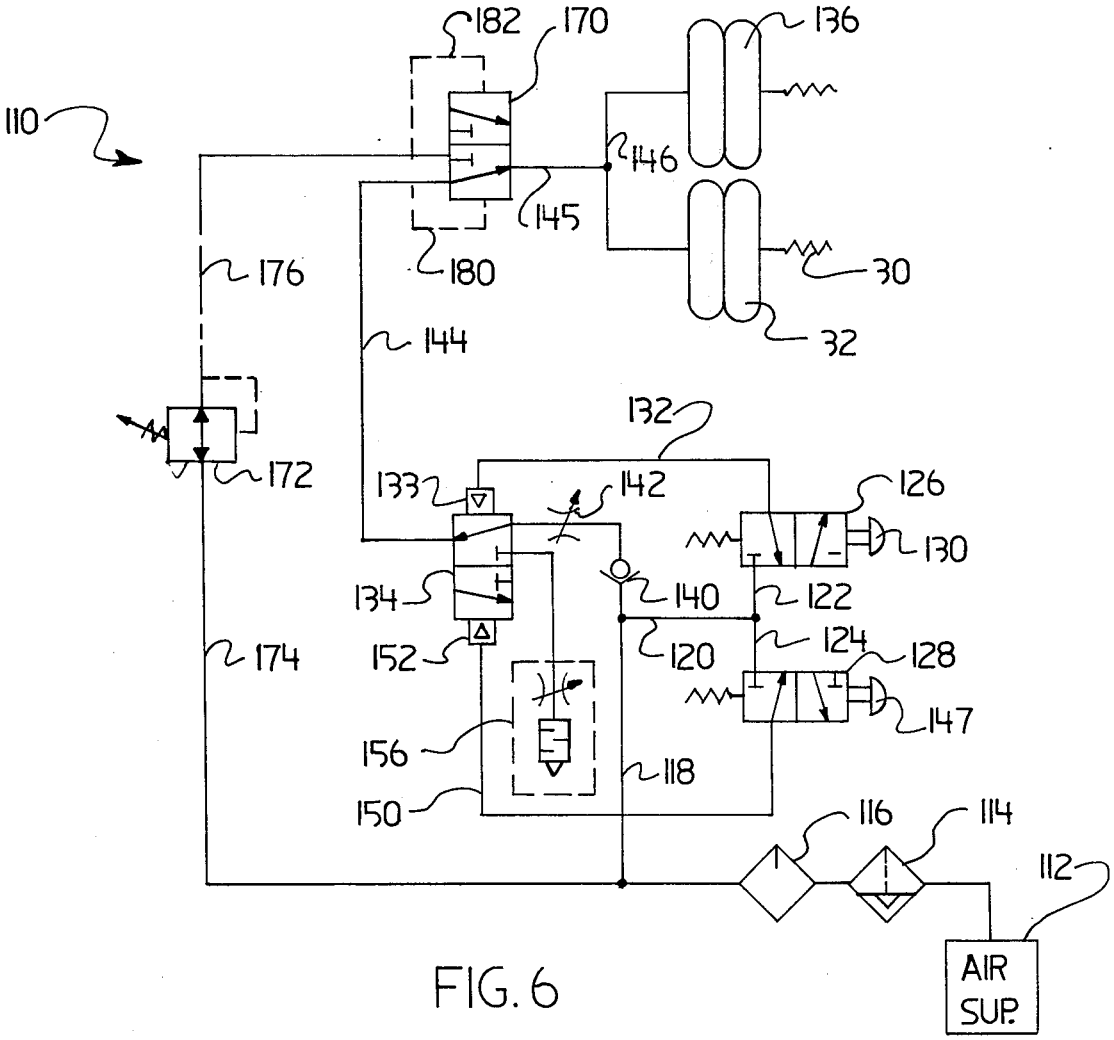
FIG. 6 is a schematic illustration of a control circuit for use with the mold handler of FIG. 1.

The shuttle valve 170 is operated between the position shown in FIG. 6 and its alternate position by the opposing pressures in conduits 180 and 182. When the pressure in conduit 180 is greater than the pressure in conduit 182 the shuttle valve 170 moves to the position shown in FIG. 6. When the pressure in conduit 180 falls below the pressure in conduit 182, the shuttle valve 170 moves to its alternate position. When in the alternate position, the valve 170 ports air at a pressure regulated by regulator 172 from conduit 176 to the motors 32 and 136 to maintain the preselected minimum pressure in the motors.

The pressure in conduit 182 is the pressure selected at the pressure regulator 172. During the "engage" operation the pressure in conduit 180 is the same as the pressure supplied by the air supply 112. When the disengage button 147 has been pressed, the pressure in conduit 180 falls as the air from the motors 32 and 136 is exhausted to the atmosphere. Thus when the disengage button 147 is pressed, the pressure in the motors 32 and 136 falls until it reaches a minimum pressure set by the regulator 172. When it starts to fall below the minimum pressure, the shuttle valve 170 shifts in the manner described above to port air to the motors 32 and 136 at the preselected minimum pressure. As has been previously discussed, this limits the extent to which the pads 14 and 16 (FIG. 1) disengage the mold 11.

When the mold handler 10 (FIG. 1) is used to lift relatively small molds 11, the pressure regulator 172 is adjusted to select a high minimum pressure. This limits the outward motion of the pads 14 and 16. The operator may adjust the minimum pressure until the disengaged pads 14 and 16 are within a few inches of the mold 11. Having the pads 14 and 16 only a small distance from the mold 11 decreases the cycling time of the mold handler 10. It also conserves energy by reducing the amount of air consumed with each cycle of operation.

It is inherent in the design of the mold handler 10 (FIG. 1) of the present invention that the pads 14 and 16 are symmetrically disposed about a vertical line through the eye 12. This assures that the center of gravity of a homogenous load will always be directly under the eye 12. The fact that the mechanisms which operate the arms 18 and 20 are identical and the fact the same pressure is supplied by conduit 146 to both motors 32 and 136 (FIG. 6) assure that the arms 18 and 20 operate symmetrically at all times.

For ease and safety of operation, the arms 18 and 20 are provided with handles 200 and 202 (FIG. 1). The handles 200 and 202 provide a convenient grip for the operator. In addition, the buttons 130 and 147 are located directly above handle 202 on the arm 20 (FIG. 2). The buttons 130 and 147 do not extend outward from the arm 20 beyond the outermost surface of the handle 202. This protects the buttons 130 and 147 from accidental actuation. For convenience, the mold handler 10 may be equipped with an additional set of control buttons 204 and 206. These buttons 204 and 206 control the roll-over operation of the mold handler 10. The buttons 204 and 206 are located directly over handle 200, and are protected by it in the same manner that buttons 130 and 147 are.

In place of the detent mechanism 73 shown in FIGS. 1 and 5, the mold handler 10 may be equipped with a power roll-over 220. The power roll-over 220 illustrated in phantom in FIG. 3 includes an electric or pneumatic motor 222 which is connected with the shaft 68 by a chain 224 and sprockets 226 and 228. By activating the motor 222 the operator is able to rotate the pad 16 and the mold 11.

Thus it is clear that the present invention provides a material handling device 10 (FIG. 1) which is adapted to handle foundry molds. This mold handler 10 has a pair of opposed gripping pads 14 and 16 to engage opposite sides of a mold 11. The pads 14 and 16 may be stroked from a disengaged position in which the pads are spaced from the mold 11 to a position where they engage opposite sides of the mold. When the mold 11 is lifted by mold handler 10, it may be turned upside down.

In addition, a mold handler 10 constructed in accordance with the present invention is adjustable to grip molds of various sizes. When it is being used to lift relatively small molds, the stroke of gripping pads 14 and 16 may be limited. Under these conditions when the pads 14 and 16 are in the disengaged portion, they are spaced from the mold 11 no farther than is actually necessary to permit the mold to be removed.

Each gripping pad 14 and 16 is connected with a downwardly extending arm 18 and 20 by means of a rotatably mounted universal joint 60 and 80. The universal joints 60 and 80 enable the pads 14 and 16 to grip the sides of a mold even when the sides are not parallel. The rotatable mounting permits the mold to be rotated about a generally horizontal axis while it is lifted by the mold handler 10.

The mold handler 10 includes a horizontal support member 22 to which the arms 18 and 20 are pivotally connected. A spring 30 urges the pad 16 toward the disengaged position by causing the arm 20 to pivot away from the mold 11. When pressurized, a pneumatic motor 32 opposes the force of the spring 30 and causes the arm 20 to pivot and the pad 16 to engage the mold 11. A similar spring and motor operate the arm 18.

A pneumatic control circuit 110 (FIG. 6) regulates the flow of air to the pneumatic motors 32 and 136. The circuit 110 enables an operator to selectively supply air to the motors to thereby engage the mold or to release the air from the motors to release the mold.

The control circuit 110 also includes a pressure regulator 172 which maintains an adjustable minimum pressure in the motors 32 and 136 at all times. By varying the minimum pressure in the motors 32 and 136, the extent to which the arms 18 and 20 pivot toward the disengaged position may be controlled. Increasing the minimum pressure increases the force opposing the springs and pivots the arms 18 and 20 and pads 14 and 16 toward an engaged position. Decreasing the minimum pressure decreases the force opposing the springs and the arms are pivoted toward a disengaged position.

What is claimed is:

1. A material handling device for releasably gripping objects of various sizes, said device comprising a pair of opposed gripping pads operable between a closed position in which said gripping pads are spaced from each other a first distance and engage opposite sides of an object and an open position in which said gripping pads are spaced from each other by a second distance larger than said first distance and in which at least one of said gripping pads is spaced from the object, spring means for urging said gripping pads away from each other and toward said open position, fluid motor means for applying a force opposed to said spring means to move said gripping pads toward said closed position when fluid pressure is applied to said fluid motor means, means for applying fluid pressure to said fluid motor means to thereby move said gripping pads toward said closed position, and adjustment means for adjusting the length of said second distance, said adjustment means including means for maintaining the pressure of the fluid supplied to said fluid motor means at an adjustable minimum whereby said fluid motor means applies at least a minimum force opposed to the force of said spring means and thereby limits the length of said second distance between said gripping pads when said gripping pads are in the open position.

2. A material handling device for releasably gripping objects of various sizes, said device comprising a pair of opposed gripping pads operable between a closed position in which said gripping pads are spaced from each other a first distance and engage opposite sides of an object and an open position in which said gripping pads are spaced from each other by a second distance larger than said first distance and in which at least one of said gripping pads is spaced from the object, a support member, a pair of arms pivotably connected with said support member and with said gripping pads, spring means for urging said gripping pads away from each other and toward said open position, fluid motor means for applying a force opposed to said spring means to move said gripping pads toward said closed position when fluid pressure is applied to said fluid motor means, means for applying fluid pressure to said fluid motor means to thereby move said gripping pads toward said closed position, said arms being pivotable under the influence of said spring means and said fluid motor means to move said pads between said first and second positions, and adjustment means for adjusting the length of said second distance, said adjustment means including means for maintaining the pressure in the supply of fluid to said fluid motor means at an adjustable minimum whereby said fluid motor means applies at least a minimum force opposed to the force of said spring means and thereby limits the length of said second distance between said gripping pads when said gripping pads are in the open position.

3. A device as set forth in claim 2 further including a pair of universal joint means for connecting said pads with said arms, said universal joint means enabling said device to grip objects having sides which extend transversely to one another.

4. A device as set forth in claim 3 further including friction means for opposing the motion of said universal joint means to thereby inhibit motion of said pads caused by the force of gravity.

5. An apparatus as set forth in claim 2 further including rotatable axle means for connecting said pads with said arms and for enabling said pads to rotate about a common axis to thereby enable an object being gripped by said device to be rotated about a generally horizontal axis.

6. A material handling device for releasably gripping objects of various sizes, said device comprising a pair of opposed gripping pads operable between a closed position in which said gripping pads are spaced from each other a first distance and engage opposite sides of the object and an open position in which said gripping pads are spaced from each other by a second distance larger than said first distance and in which at least one of said gripping pads is spaced from the object, a transverse support member, a pair of downwardly depending arms pivotably connected with said support member, a rotatably mounted universal joint connected with the lower end portion of each of said arms for connecting each of said arms with one of said gripping pads, said universal joints being adapted to enable an object gripped by said device to be rotated about a generally horizontal axis while said pads are in said closed position, and to enable said pads to engage an object which has opposite sides extending transversely to each other, spring means for urging said gripping pads away from each other and toward said open position, said spring means including one spring associated with each of said arms to urge said arms to pivot the lower end portions of said arms away from each other to thereby move said gripping pads to said open position, fluid motor means for applying a force opposed to said spring means to move said gripping pads toward said closed position when fluid pressure is applied to said fluid motor means, means for applying fluid pressure to said fluid motor means to thereby move said gripping pads toward said closed position, said fluid motor means including a fluid motor associated with each of said arms to urge said arms to pivot the lower end portions of said arms toward each other against the influence of said spring means to move said gripping pads to said closed position, and adjustment means for adjusting the length of said second distance, said adjustment means including means for maintaining the pressure in the supply of fluid to said fluid motor means at an adjustable minimum whereby said fluid motor means applies at least a minimum force opposed to the force of said spring means and thereby limits the length of said second distance between said gripping pads when said gripping pads are in the open position.

7. A material handling device for releasably gripping objects of various sizes, said device comprising a support member, a pair of arms pivotably connected with said support member, a pair of opposed gripping pads one of which is connected with each of said arms, said arms being operable between a closed position in which said gripping pads engage opposite sides of the object and an open position in which at least one of said gripping pads is spaced from the object, spring means for urging said gripping pads away from each other and toward said open position, fluid motor means for applying a force opposed to said spring means to move said gripping pads toward said closed position when fluid pressure is supplied to said fluid motor means, said arms being pivotable under the influence of said spring means and said fluid motor means to move said pads between said open and closed positions, fluid control means for applying an adjustable minimum fluid pressure to said fluid motor means to thereby adjustably limit the maximum motion of said arms between said first and second positions, rotatable axle means for connecting said pads with said arms and for enabling said pads to rotate about a common axis to thereby enable an object being gripped by said device to be rotated about a generally horizontal axis, and motor means connected with at least one of said pads.

8. A device as set forth in claim 7 wherein said axle means include detent means for enabling said pads to be retained preferentially in preselected angular positions as said pads are rotated.

9. A material handling device for releasably gripping objects of various sizes, said devices comprising a pair of opposed gripping pads operable between a closed position in which said gripping pads engage opposite sides of the object and an open position in which at least one of said gripping pads is spaced from the object, spring means for urging said gripping pads away from each other and toward said open position, fluid motor means for applying a force opposed to said spring means to move said gripping pads toward said closed position when fluid pressure is applied to said fluid motor means, and fluid control means for applying an adjustable minimum fluid pressure to said fluid motor means to thereby adjustably limit the maximum motion of said arms between said open and closed positions, said fluid control means including valve means for controlling the application of pressurized fluid to said fluid motor means to thereby control the movement of said gripping pads toward one another and shuttle valve means for controlling the flow of fluid out of said fluid motor means to thereby limit the extent of motion of said arms away from each other, said shuttle valve means being movable between a first position in which fluid at a first pressure may flow between said valve means and said motor means and a second position in which said fluid control means supplies fluid at a preselected second pressure to said motor means, said shuttle valve means moving from said first position to said second position when said first pressure is less than said second pressure, and said shuttle valve means moving from said second position to said first position when said first pressure is greater than said second pressure.

10. A material handling device for releasably gripping objects of various sizes, said device comprising a transverse support member, a pair of downwardly depending arms pivotably connected with said support member, a pair of opposed gripping pads, a rotatably mounted universal joint connected with the lower end portion of each of said arms connecting each of said arms with one of said pair of gripping pads, said gripping pads being operable between a closed position in which said gripping pads engage opposite sides of the object and an open position in which at least one of said gripping pads is spaced from the object, said universal joints being adapted to enable an object gripped by said device to be rotated about a generally horizontal axis while said pads are in said closed position and to enable said pads to engage an object which has opposite sides extending transversely to each other, spring means for urging said gripping pads away from each other and toward said open position, said spring means including one spring associated with each of said arms to urge said arms to pivot the lower end portions of said arms away from each other to thereby move said gripping pads to said open position, fluid motor means for applying a force opposed to said spring means to move said gripping pads toward said closed position when fluid pressure is applied to said fluid motor means, said fluid with each of motor means including a fluid motor associated with each of said arms to urge said arms to pivot the lower end portions of said arms toward each other against the influence of said spring means to move said gripping pads to said closed position, fluid control means for applying adjustable minimum fluid pressure to said fluid motor means to thereby adjustably limit the maximum motion of said arms between said open and closed positions, said fluid control means including valve means for controlling the application of pressurized fluid to said fluid motor means to thereby control the movement of said gripping pads toward one another and shuttle valve means for controlling the flow of fluid out of said fluid motor means to thereby limit the extent of motion of said arms away from each other, said shuttle valve means being movable between a first position in which fluid at a first pressure may flow between said valve means and said motor means and a second position in which said fluid control means supplies fluid at a preselected second pressure to said motor means, said shuttle valve means moving from said first position to said second position when said first pressure is less than said second pressure, and said shuttle valve means moving from said second position to said first position when said first pressure is greater than said second pressure.

11. A material handling device comprising first and second gripping arms for gripping an object, said first and second arms being movable between an engaged position in which said arms engage the object and a disengaged position in which at least one of said arms is spaced from the object, first spring means for urging said first arm away from said engaged position and toward said disengaged position and second spring means for urging said second arm away from said engaged position and toward said disengaged position, said first and second spring means applying substantially identical spring forces to said first and second arms to urge said arms toward said disengaged position, first motor means responsive to fluid pressure for applying a first motor force to move said first arm from said disengaged position toward said engaged position against the influence of said spring means, second motor means responsive to fluid pressure for applying a second motor force to move said second arm from said second disengaged position toward said engaged position against the influence of said second spring means, said first and second motor forces being substantially identical to thereby cause said first and second arms to move substantially the same distance from said disengaged position to said engaged position, thereby engaging the object with said arms in a position central between said arms, valve means for controlling the application of pressurized fluid to said first and second motor means to thereby control the movement of said arms toward said engaged position, and shuttle valve means for controlling the flow of fluid out of said motor means to thereby limit the extent of motion of said arms toward said disengaged position, said shuttle valve means being movable between a first position in which fluid at a first pressure may flow between said valve means and said first and second motor means and a second position in which said fluid control means supplies fluid at a preselected second pressure to said motor means, said shuttle valve means moving from said first position to said second position when said first pressure is less than said second pressure and said shuttle valve means moving from said second position to said first position when said first pressure is greater than said second pressure.

* * * * *

UNITED STATES PATENT AND TRADEMARK OFFICE

CERTIFICATE OF CORRECTION

PATENT NO. : 4,254,984

DATED : March 10, 1981

INVENTOR(S) : Abraham et al.

It is certified that error appears in the above-identified patent and that said Letters Patent are hereby corrected as shown below:

Column 10, line 16, change "devices" to --device--.

Column 11, line 4, delete "with";

line 5, delete "each of".

Signed and Sealed this

Second Day of June 1981

[SEAL]

Attest:

RENE D. TEGTMEYER

Attesting Officer

Acting Commissioner of Patents and Trademarks